United States Patent [19]

Feinberg et al.

[11] 4,101,029

[45] Jul. 18, 1978

[54] TENNIS BALL REJUVENATOR AND MAINTAINER

[76] Inventors: Robert S. Feinberg, 81 Edgemont Pl., Teaneck, N.J. 07066; David A. Selick, 76 LeRoy St., Tenafly, N.J. 07670

[21] Appl. No.: 837,783

[22] Filed: Sep. 29, 1977

[51] Int. Cl.[2] ..... B65D 85/16

[52] U.S. Cl. ..... 206/315 B; 220/240; 220/327; 220/358

[58] Field of Search ..... 206/315 B, 315 R; 220/240, 327, 328, 206, 208, 357, 358, 366

[56] References Cited

U.S. PATENT DOCUMENTS

| | | | |
|---|---|---|---|
| 2,355,108 | 8/1944 | Reese | 206/315 B |
| 2,499,614 | 3/1950 | Thornhill | 220/327 |
| 3,173,265 | 3/1965 | Bixby | 220/328 |
| 3,235,121 | 2/1966 | Hexel | 220/358 |
| 3,415,357 | 12/1968 | VanNatter | 206/315 B |
| 3,853,222 | 12/1974 | Helms | 206/315 B |
| 3,889,807 | 6/1975 | Feinberg et al. | 206/315 B |

*Primary Examiner*—Steven E. Lipman
*Assistant Examiner*—Bruce H. Bernstein
*Attorney, Agent, or Firm*—Howard C. Miskin

[57] ABSTRACT

A pressure vessel for storing tennis balls includes a cylindrical open topped receptacle having in its inside upper border a peripheral groove separably engaging an elastomeric O-ring gasket provided with a finger removal tab. A vertical coaxial post is anchored to the receptacle base and axially movably supports for movement between limited raised and depressed positions a coupling member which is spring urged to raised position and releasably locked in its depressed position. A dished cover is coaxially separably connected to the coupling member and has an outwardly downwardly inclined peripheral lip engaging the O-ring when the cover is in raised position to effect an air tight seal. Mounted on the receptacle peripheral wall and communicating with the interior thereof are a pressure gauge, a pressure release and safety valve and a pressurizing check valve.

12 Claims, 7 Drawing Figures

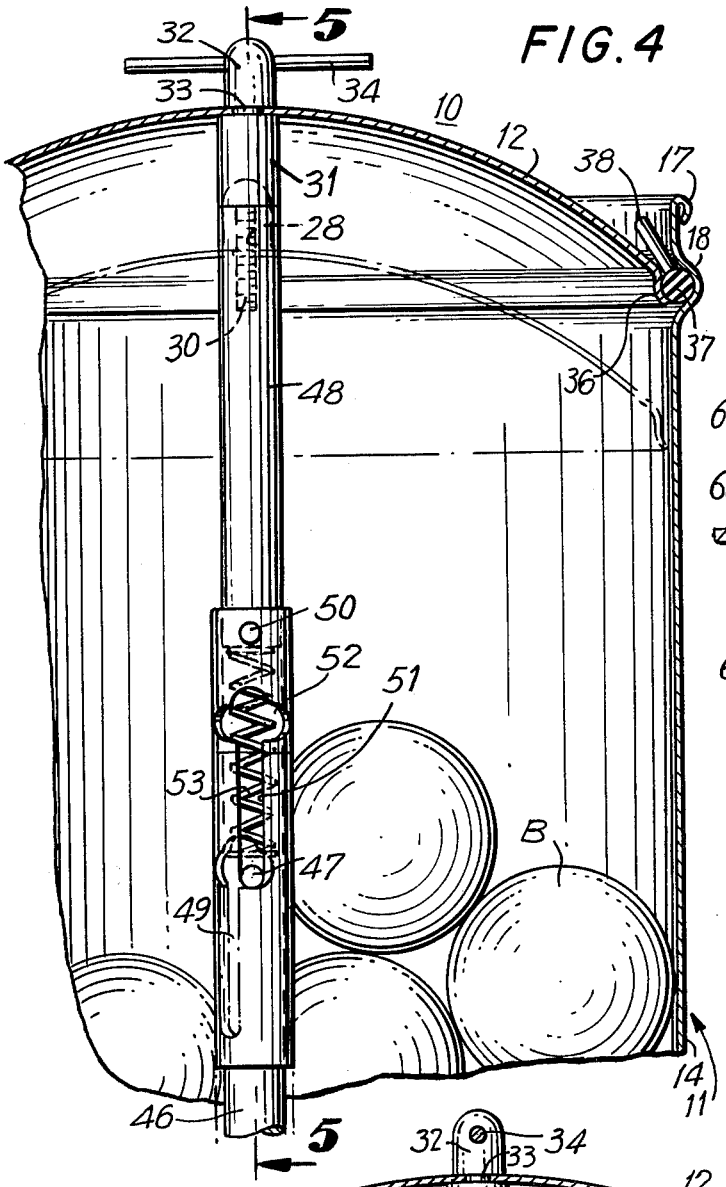
FIG. 4
5
32
33
34
10
12
38
17
31
28
18
30
37
36
48
50
52
51
53
47
49
B
14
11
46
5
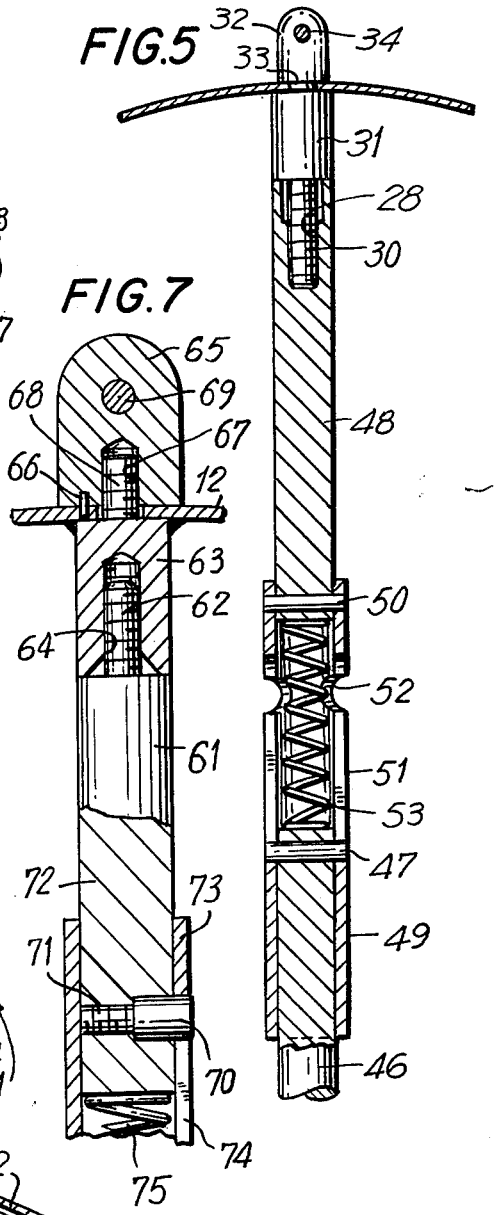
FIG. 5
32
33
34
31
28
30
48
50
52
51
53
47
49
46
FIG. 7
65
69
68
67
66
12
63
62
64
61
72
73
71
70
74
75
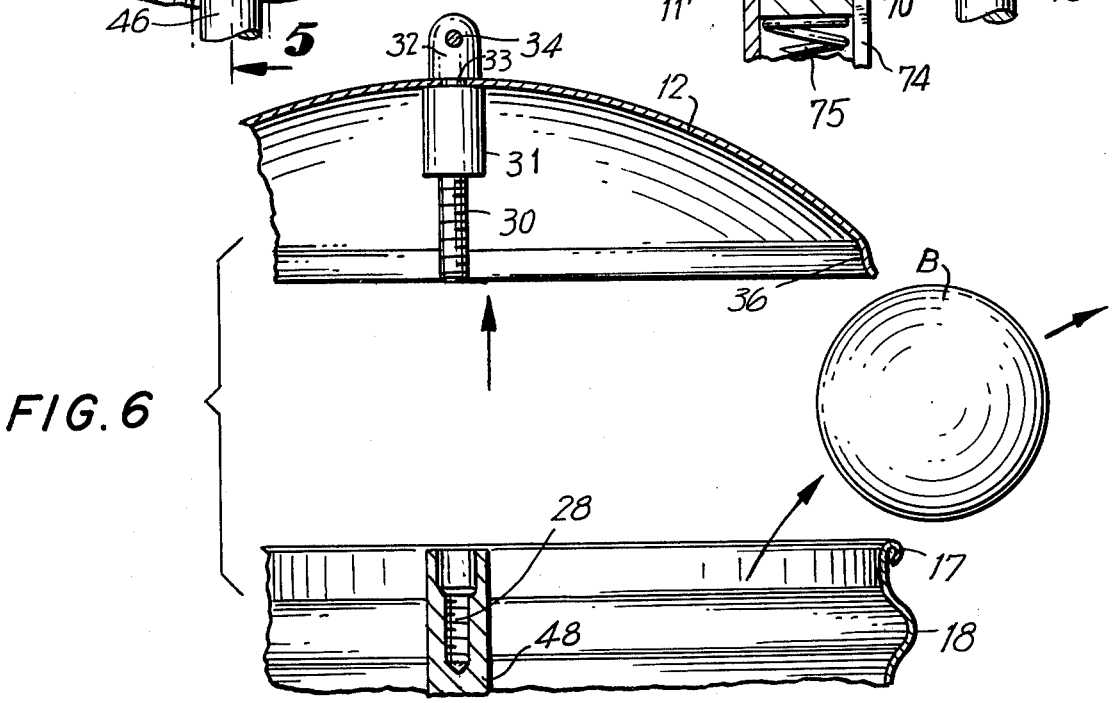
FIG. 6
32
33
34
12
31
30
36
B
28
17
48
18

TENNIS BALL REJUVENATOR AND MAINTAINER

BACKGROUND OF THE INVENTION

The present invention relates generally to improvements in pressurized storage receptacles and it relates particularly to an improved pressurized receptacle for storing a large number of gas pressurized balls under an external gas pressure to maintain the liveliness and optimum configuration of the individual balls.

In the playing of tennis and many other ball games, a gas pressurized hollow ball is employed, and in a case of tennis the ball is spherical and of a standard diameter and it is covered with a fibrous nap. Important parameters of the ball are its bounce or liveliness and this is a function of the ball's internal gas pressure, its size and spherical configuration and the condition of the fibrous nap. All of these parameters should be maintained constant and uniform from ball to ball and during the useful life of the ball. Since the reaction of the ball to the impact of the racket and its ground rebound characteristics are functions of the above parameters any significant change or variation thereof adversely affects the proper playing of the game.

Tennis balls are generally packaged and marketed in pressurized hermetically sealed containers so as to minimize or prevent any diffusion outwardly of the pressurized gas in the ball which would reduce its liveliness and so as to obviate any distortion of the ball from its standard size or shape as a consequence of the ball's high internal pressure. However, upon opening the pressurized container the diffusion of the pressured gas from the ball and the distortion of the ball commences so that the ball is thereafter of limited useful life in the proper playing of tennis. Many devices, both of a gas pressurized and a mechanical pressing nature have heretofore been proposed for extending the life of the ball by maintaining the ball's internal pressure and shape and size. As an example, our earlier patent, U.S. Pat. No. 3,889,807 discloses several devices which produce excellent results, but are limited to the number of balls that can be acted upon. Other devices are often complex and inconvenient to employ or they have been unsatisfactory in that they tended to damage the surface of the ball, thereby adversely affecting the ball's playing properties and otherwise left much to be desired.

SUMMARY OF THE INVENTION

It is a principal object of the present invention to provide an improved device for preserving the playing characteristics of an internally gas pressurized ball.

Another object of the present invention is to provide an improved vessel for preserving the playing characteristics of a supply of internally gas pressurized balls during the prolonged storage thereof.

Still another object of the present invention is to provide an improved pressure vessel for storing a supply of gas pressurized balls, such as tennis balls and the like, to preserve their original liveliness, bounce, configuration and shape.

Still a further object of the present invention is to provide an improved vessel of the above nature characterized by its simplicity, ruggedness, reliability, ease and convenience of use and application, and great versatility and adaptability.

The above and other objects of the present invention will become apparent from a reading of the following description taken in conjunction with the accompanying drawings which illustrate preferred embodiments thereof.

In a sense, the present invention contemplates the provision of an improved pressure vessel for the storage of internally gas pressurized balls such as tennis balls comprising an open topped cylindrical vessel including a bottom wall and a cylindrical peripheral wall, said peripheral wall having a peripheral groove formed on the inside face of its upper border. An annular resilient compressible gasket separably engaging said groove, a cover member separably vertically movably registering with the upper part of the interior of said receptacle and having an outwardly downwardly directed peripheral lip engaging the inner lower face and side face of said gasket when said cover is in a raised condition in said receptacle, spring means urging said cover to said raised position and means for introducing a gas under pressure into said receptacle when closed by said cover.

According to a preferred embodiment of the present invention a vertical tubular post is anchored to the receptacle bottom wall and extends coaxially to the upper part of the cylindrical vessel, the post having formed in its upper wall a vertical slot terminating at its bottom in a peripheral slot. A piston member slideably engages and projects above the interior of the post and biased upwardly by a spring housed in the post, the piston carrying a radial pin which slideably engages the slot to permit the limited vertical movement of the piston and the releasable locking thereof in its lower spring loaded position when the pin engages the slot peripheral section. The piston is thread connected to a hub coaxially secured to the cover and having an upper handle portion. In a modified form of the improved vessel the tubular post is replaced by a solid post whose upper part is axially slideably engaged by a sleeve which is spring urged upwardly by a spring housed therein and is provided with a vertical slot joining at its top end, a peripheral slot. The sleeve slot slideably engages a radial pin projecting from the post and a shank projects upwardly from the sleeve and is separably connected to the cover. A further modified form uses a post which has at its end a male threaded finger, which threadedly mates with a female threaded adapter attached to the cover. In all other respects the two embodiments are similar. Both forms of the device have mounted in the receptacle peripheral wall a pressure gauge, and a hand controlled pressure release and safety valve.

The improved pressure vessel is rugged, simple, and reliable, easy and convenient to use, of great versatility and adaptability, and makes maximum use of commercially available components.

BRIEF DESCRIPTION OF THE DRAWINGS

FIG. 4 is a fragmentary medial vertical cross-sectional view of another embodiment of the present invention;

FIG. 5 is a sectional view taken along line 5—5 in FIG. 4;

FIG. 6 is a view similar to FIG. 4 but showing the cover in open position attendant to the removal of a ball; and FIG. 7 is a sectional view similar to FIG. 5, showing a further embodiment of the present invention.

DESCRIPTION OF THE PREFERRED EMBODIMENTS

Figure 1:
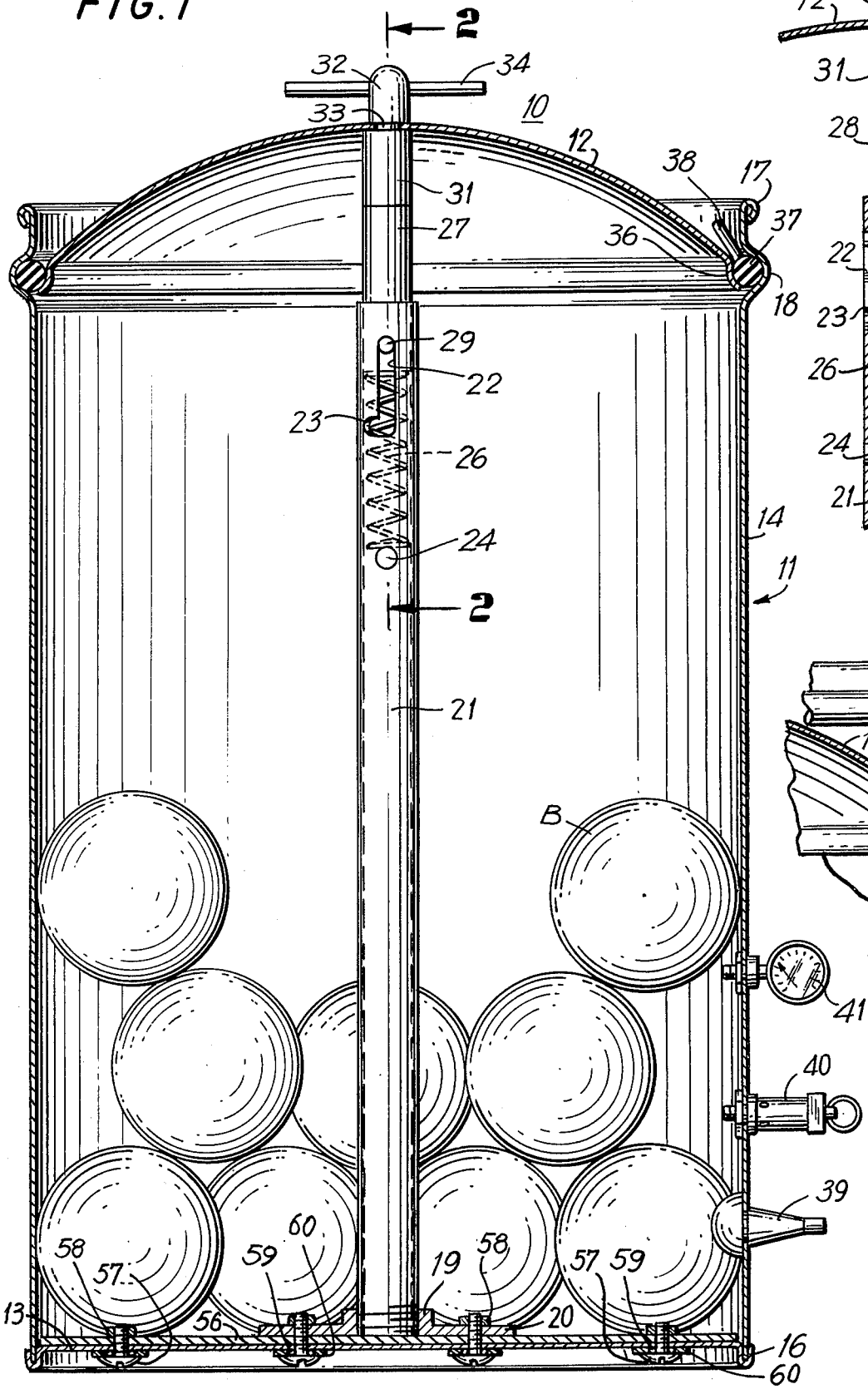
FIG. 1 is a medial vertical cross-sectional view of a pressure vessel embodying the present invention.
Figure 2:
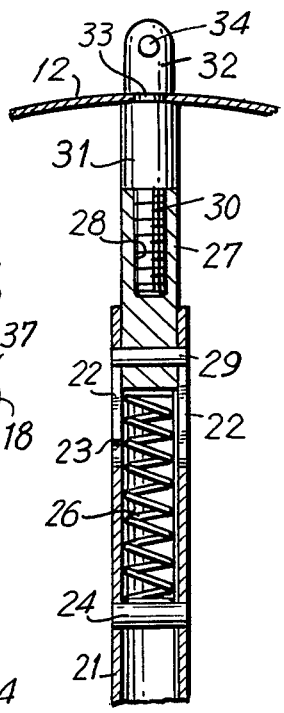
FIG. 2 is a sectional view taken along line 2—2 in FIG. 1.
Figure 3:
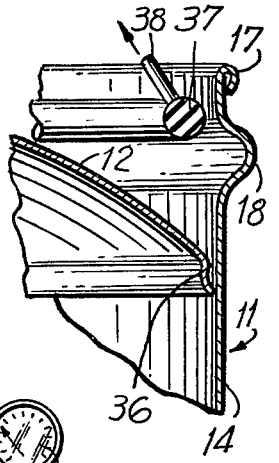
FIG. 3 is a fragmentary vertical sectional view of the vessel showing the cover in depressed position and the separation of the sealing gasket.

Referring now to the drawings, particularly FIGS. 1 to 3 thereof, which illustrate a preferred embodiment of the present invention the reference numeral 10 generally designates the improved pressure vessel illustrated as storing under pressure a plurality of tennis balls B, it being understood that more or less balls than those shown may be stored and that other internally gas pressured balls than tennis balls may be stored. The vessel 10 comprises an open topped arcular cylindrical main receptacle 11 with air tight walls and seams and a closure member or cover 12.

The receptacle 11 includes a flat circular bottom wall 13 and a circular peripheral cylindrical wall 14 which projects upwardly from the edge of bottom wall 13 and is clinched and hermetically sealed thereto by a suitable peripheral seam 16. The receptacle 11 may be formed from a conventionally fabricated sheet metal pail or can and may be provided with the usual bail to facilitate the carrying thereof. Generally the bottom wall 13 of a standard sheet metal pail should be strengthened to resist the pressure applied during use. As shown, a reinforcing disk 56, preferably made of steel and of a diameter corresponding to the diameter of bottom 13 is attached to bottom wall 13, by bolts 57 and nuts 58. The heads of bolts 57 have a smaller height than the length of seam 16. The holes in the base 13 through which bolts 57 pass are sealed. As shown, O-rings 59 are positioned between the head of each bolt 57 and the outer surface of bottom 13 and between the shank of bolt 57 and the inner peripheral surface of steel washers 60 around the shank of bolt 57. The O-rings 59 are thus surrounded and prevented from expanding under pressure so as to lose their sealing ability. Advantageously, six bolts 57 and nuts 58 extend about bottom 13 equidistant about a circle 1 inch from the outer periphery. The top edge of the wall 14 is outwardly beaded as a 17 and formed in the inside face of wall 14 shortly below bead 17 is an arcuate annular or peripheral groove 18 convexly rounded at its upper and lower edges and imparting a corresponding outward annular bulge to wall 14.

An internally threaded collar 19 provided at its lower edge with a wide outwardly directed peripheral flange which is coaxially secured to disk 56 by means bolts 57 passing through bottom 13 and disk 56 and threadedly fastened by nuts 58. Bolts 57 are sealed by O-rings 59 and washers 60 as previously described. A vertical hollow tubular post 21 is externally threaded at its bottom and tightly screwed engages the collar 19 and extends coaxially vertically upwardly to about the level of the bottom edge of groove 18. Formed in the wall of the upper part of post 21 are opposed vertical slots 22 and short horizontally directed locking slots 23 generally perpendicular thereto which join at their bottoms which are common and extend in a common direction.

An abutment pin 24 extends diametrically across post 21 and is anchored thereto a distance somewhat below peripheral slots 23 and a helical compression spring 26 which rest on pin 24. While opposed slots 22 and 23 are illustrated, single slot 22 and slot 23 may be used, which then will require pin 24 to extend in one direction only, not diametrically. A cylindrical piston 27 provided in its upper part with a tapped axial bore 28 coaxially slideably engages the bore of the upper part of post 21 and projects above the post 21 and is slideably and turnably retained therein by a diametrically extending follower pin 29 affixed in and projecting beyond the diametric bore in the lower part of piston 27 and slideably received in and engaging slots 22 and 23. In the topmost raised postion of piston 27, as shown in FIGS. 1 and 2, pin 29 is in the top of slots 22 and spring 26 is slightly compressed by the underface of piston 27 and in the locked, depressed position, the extensions of pin 29 engage slots 23 and spring 26 is fully compressed or loaded by piston 27.

A cylindrical hub 31 of the same diameter as piston 27 is separably coaxially coupled to piston 27 by a coaxial threaded shank 30 depending from hub 31 and matingly engaging tapped bore 28. Concentrically resting atop hub 31 and firmly fastened thereto by an upwardly projecting handle shank 32, which is secured to hub 31 by a pin section 33 projecting through a coaxial opening in cover 12 and affixed to hub 31, is the cover 12. Handle shank 32, cover 12 and hub 31 are integrally and sealably joined by means of pin 33 inserted into hub 31 and solder being applied to the junction of these elements. A pair of opposing radially projecting handle members or wing 34 extend from shank 32 to facilitate the turning of hub 31, and its coupling and uncoupling to piston 27.

The cover 12 is formed of metal and is dished or upwardly convex and downwardly concave and terminates in a depending annular lip 36 which is slightly outwardly inclined and is outwardly concave with a curvature approximately that of groove 18. The diameter of the outer peripheral edge of lip 36 is equal to or slightly less than the inside diameter of peripheral wall 14 of receptacle 11.

A flexible compressible annular gasket 37 separably engages and partially nests in groove 18, projecting inwardly thereof and is advantageously an O-ring or torus of elastomeric material. As shown in FIG. 1, in the closed raised position of cover 12, the gasket 37 is tightly embraced and compressed by the confronting faces of lip 36 and groove 18 to effect an hermetic seal. A finger tab 38 is secured to and projects upwardly inwardly from gasket 37 to facilitate the separation and application thereof.

In order to facilitate the proper pressurizing of the interior of closed vessel 10, there is mounted on the peripheral wall 14 in communication with the interior of vessel 10 a tubular valve stem 39 of the vehicle tire inflation type including the conventional Shroeder check valve 39, a pressure relief valve 40, which is manually selectively opened and closed to release the pressure in the vessel 10 and permit the safe opening thereof and which is a safety release valve which opens when the vessel exceeds an adjustable predetermined gas pressure level, the valve 40 being of known or conventional construction, and a pressure gauge 41.

In the use and application of the improved vessel 10 described above, the cover 12 is depressed in the depressurized receptacle 11 and locked in such position by turning cover 12 to bring pin 29 into engagement with slot 23 and the gasket 37 is separated from groove 18 and removed by means of tab 38. The cover is then turned counter clockwise to bring pin 29 into engagement with the top of slot 22 and lock the piston 27 against further rotation and unscrew hub 31 from piston 27 to permit the removal of the cover 12 and opening of the receptacle 11. Balls B are then deposited in the receptacle 11 and the cover 12 is recoupled by screwing hub 31 to piston 27. Cover 12 is depressed to below groove 18, as shown in FIG. 3, and is releasably locked by turning to bring pin 29 into engagement with slot 23. The gasket 37 is reapplied to groove 18 and the cover handle is turned to release pin 29 from slot 23 whereby spring 26 raises the cover assembly to bring lip 36 into air tight engagement with gasket 37. Compressed air is then introduced into the closed vessel 10 by way of valve 39 until an optimum pressure is achieved as read from pressure gauge 41. The increased pressure in vessel 10 expands the cover 12 to compress gasket 37 between the confronting faces of lip 36 and groove 18 to effect a reliable air tight or hermetic seal. The balls B may now be optimumly stored for as long as desired. In the event of an excessive increase in the vessel pressure due to a temperature rise or the like, beyond a preset value, the valve 40 automatically releases the excess air from the vessel until the desired lower pressure is released. In order to remove balls B, valve 40 is manually opened until the vessel internal pressure reaches atmospheric and the cover 12 is removed in the manner earlier described.

In FIGS. 4 to 6 there is illustrated another embodiment of the present invention which differs from that first described only in the arrangement for vertically movably supporting and locking the cover assembly, in all other respects, and in their operation the two embodiments are similar and require no further detailed explanations.

Specifically, a vertical coaxial solid cylindrical post 46 is concentrically anchored to the bottom wall of receptacle 11, which could include disk 56, as earlier described, and terminates considerably below the level of peripheral groove 18. A pin 47 extends through and projects beyond a diametric bore formed in the upper part of post 46. A vertical cylindrical shank 48 coaxially depends from and is separably coupled to the cover 12 and is coaxial with and above post 46 and of the same diameter thereof, and has a tapped axial bore 28. An elongated sleeve 49 coaxially depends from and engages the bottom part of shank 48 and is affixed thereto by a coupling pin 50. The sleeve 49 slideably and rotatably engages the upper part of post 46 and has formed therein a pair of diametrically opposed T-shaped slots including vertical slot sections 51 and peripheral cross slot or peripheral sections 52. The slots 51 and 52 slideably engage the follower pins 47 and a helical compression spring 53 is entrapped between the confronting end faces of post 46 and shank 48. While pin 47 is illustrated diametrical, it could extend radially, and only one T-shaped slotted sections 51 and 52 need be provided.

The operation of the embodiment of the invention last described is similar to that first described, the cover assembly being releasably locked in its depressed position by lowering it to compress spring 53 and turning the assembly to bring outer ends of peripheral slots into engagement with follower pin 47.

A further embodiment of the present invention is illustrated in FIG. 7, which differs from the earlier described second embodiment only in the arrangement for vertically movably supporting and locking the cover assembly. In all other respects and in their operation, these two embodiments are similar and require no additional explanation.

Specifically, a vertical cylindrical piston 61 coaxially depends from and is separably coupled to cover 12 and is coaxial with and above hollow post 73, partially illustrated. Post 73 is coupled to piston 61 in the same general manner as post 21 is coupled to piston 27 in the first embodiment. Extending axially from the end piston 61 is a threaded finger 62. A cylindrical hub 63 of the same diameter as piston 61 is provided in its lower end with a tapped axial bore 64, and extending coaxially from its upper end a threaded finger 68. Hub 63 is separably coaxially coupled to piston 61 by threaded finger 62 matingly engaging tapped bore 64. Cover 12 concentrically rests atop hub 63 and is firmly fastened thereto by an upwardly projecting handle shank 65. A pin section 66 projecting through a coaxial opening in cover 12 prevents rotation between shank 65 and cover 12. Shank 65, cover 12 and hub 63 are sealed by solder similarly as described above. Shank 65 has a tapped axial bore 67 which threadedly mates with finger 68 of hub 63. Piston 61 coaxially slideably engages the bore of the uper part of post 73 and projects above the post 21 and is slideably and turnably retained therein by a radially extending follower pin 70 having a threaded portion 71 affixed in and projecting beyond a radial threaded bore 72 in the lower part of piston 61 and slideably engaging slot 74 in post 73. In the topmost raised position of piston 61, as shown in FIG. 7, pin 70 is in the top of slot 74 and spring 76 is slightly compressed by the underface of piston 61. Locking is done in a manner similar to that earlier described with respect to FIG. 1.

The operation of this last embodiment is similar to that second described above.

The last described embodiment allows a simple replacement of piston 61, if the male threaded finger 62 became bent, as contrasted with the embodiment of FIGS. 4–6. Also, bore 64 faces inwardly and thus is less likely to collect dirt in use.

While parts of the post and cover assembly were illustrated having the same diameters, they may vary. Also, the compression spring 26 and 53 may be too strong to initially turn the cover assembly by handles 34, which then merely require turning the cover by the user directly until the cover 12 is locked. Also, to break the binding of the threaded piston with the cover hub assembly, the handles 34 and 69 do not normally provide sufficient torque, thus usually requiring initially turning the cover directly by the user and then spinning the cover with the handle members.

While there have been described and illustrated preferred embodiments of the present invention, it is apparent that numerous alterations, omissions and additions may be made without departing from the spirit thereof.

We claim:

1. A pressure vessel comprising an open topped cylindrical receptacle including a bottom wall and an upstanding peripheral wall having a peripheral groove formed in the inside face of its upper border, a compressible annular gasket removably engaging said peripheral groove and projecting inwardly of the inside face of said peripheral wall, a circular cover member having a depending outwardly inclined peripheral border with an outer diameter less than the outside diameter of said gasket and not exceeding the inside diameter of said peripheral wall, said border including means to receive the gasket in sealing relationship guide means separably connected to said cover for supporting said cover for vertical movement in said receptacle between a raised closed position with said gasket embraced between said cover border and a face of said groove and a depressed position below and out of engagement with said gasket, and means for introducing a pressurized gas into the closed vessel.

2. The pressure vessel of claim 1 including spring means urging said cover member to its raised position and said gasket comprises an elastomeric O-ring.

3. The pressure vessel of claim 1 wherein said guide means comprises a vertical post coaxially anchored to said receptacle bottom wall, a slide member vertically slideably engaging the upper part of said post and means separably coupling said cover member to said slide member.

4. The pressure vessel of claim 3 including spring means upwardly biasing said cover toward its closed position and a stengthening disk abutting and fixedly secured to said receptacle bottom wall.

5. The pressure vessel of claim 3 wherein said post comprises a vertical tube having formed in its upper part a vertical slot terminating at its bottom in a peripherally extending slot, and said slide member comprises a piston slideably engaging the bore of said post and having a radially projecting follower element slideably engaging said slot.

6. The pressure vessel of claim 5 including an abutment element located in said bore below said slot and a helical compression spring entrapped between said abutment and said piston.

7. The pressure vessel of claim 3 wherein said slide member comprises a sleeve member vertically slideably coaxially engaging the upper part of said post, and having formed therein a vertical slot terminating at its top in a peripherally extending slot, and including an outwardly projecting follower element affixed to said post and slideably engaging said slot.

8. The pressure vessel of claim 7 including an abutment in said sleeve and a compression spring entrapped between said abutment member and said post.

9. The pressure vessel of claim 3 wherein said cover coupling means includes a hub fixedly secured to said cover and a shank fixedly secured to said post, and threaded coupling means removably coupling said hub and said shank.

10. The pressure vessel of claim 9 wherein said hub has an axial threaded bore and said shank has an axially extending threaded finger adapted to mate with said hub threaded bore.

11. The pressure vessel of claim 1 wherein said pressurized gas introducing means comprises a tubular valve member mounted on said peripheral wall.

12. The pressure vessel of claim 11 including a pressure gauge and a pressure release valve mounted on said peripheral wall and communicating with the interior of said receptacle.

* * * * *

UNITED STATES PATENT OFFICE

CERTIFICATE OF CORRECTION

Patent No. 4,101,029 Dated July 18, 1978

Inventor(s) Robert S. Feinberg & David A. Selick

It is certified that error appears in the above-identified patent and that said Letters Patent are hereby corrected as shown below:

On the Title Page Item 76 should read -- Inventors: Robert S. Feinberg, 81 Edgemont Pl., Teaneck, N.J. 07666; David A. Selick, 76 LeRoy St., Tenafly, N.J. 07670 --.

Signed and Sealed this

*Fifteenth* Day of *May 1979*

[SEAL]

*Attest:*

RUTH C. MASON
*Attesting Officer*

DONALD W. BANNER
*Commissioner of Patents and Trademarks*